US007290355B2

(12) United States Patent
Labonté

(10) Patent No.: US 7,290,355 B2
(45) Date of Patent: Nov. 6, 2007

(54) SKATE BOOT COMPRISING A TONGUE

(75) Inventor: Ivan Labonté, Montreal (CA)

(73) Assignee: Bauer Nike Hockey Inc., St-Jérôme, Québec (CA)

( * ) Notice: Subject to any disclaimer, the term of this patent is extended or adjusted under 35 U.S.C. 154(b) by 373 days.

(21) Appl. No.: 10/810,554

(22) Filed: Mar. 29, 2004

(65) Prior Publication Data

US 2005/0210707 A1 Sep. 29, 2005

(51) Int. Cl.
*A43B 23/26* (2006.01)
*A43B 13/22* (2006.01)

(52) U.S. Cl. ..... 36/54; 36/72 R

(58) Field of Classification Search ..... 36/117.1, 36/117.6, 54, 99, 101
See application file for complete search history.

(56) References Cited

U.S. PATENT DOCUMENTS 1,974,721 A * 9/1934 Miller ..... 36/54
2,022,554 A * 11/1935 Williams ..... 36/54
2,334,133 A * 11/1943 Shields ..... 36/54
4,126,951 A * 11/1978 Antonious ..... 36/54
5,154,011 A * 10/1992 Holzl et al. ..... 36/54
5,289,645 A * 3/1994 Marega et al. ..... 36/54
5,341,583 A * 8/1994 Hallenbeck ..... 36/54
5,575,090 A * 11/1996 Condini ..... 36/54
5,738,937 A * 4/1998 Baychar ..... 36/44
6,094,841 A * 8/2000 Adams ..... 36/54
6,128,837 A * 10/2000 Huang ..... 36/54
6,381,877 B2 5/2002 Filice
6,574,887 B2 6/2003 Jones et al.
2002/0133979 A1 9/2002 Gantier
2005/0204585 A1* 9/2005 Loveridge et al. ..... 36/54

* cited by examiner

*Primary Examiner*—Ted Kavanaugh

(57) ABSTRACT

A skate boot for enclosing a human foot having a forefoot and a front ankle portion. The skate boot has a tongue comprising a first section and a second section. The first section covers the forefoot of the foot and the second section is connected to the first section via a flexing zone that enables the second section to be movable in relation to the first section between a first position and a second position. In the first position the second section covers a portion of the front ankle portion of the foot, and in the second position, the second section overlaps a portion of the first section.

23 Claims, 6 Drawing Sheets

SKATE BOOT COMPRISING A TONGUE

FIELD OF THE INVENTION

The present invention relates to a skate boot comprising a tongue having first and second sections connected via a flexing zone such that the second section is movable relative to the first section between two positions.

BACKGROUND OF THE INVENTION

Skate boots having tongues for covering the forefoot and front ankle portion of a wearer are known in the art. Typically, such tongues have a first end portion affixed to the toe cap of the skate boot, and extend therefrom for covering the forefoot and front ankle portion of the wearer's foot.

However, a deficiency with existing tongues is that they may restrict the wearer's range of ankle movement and they may not provide sufficient protection to the wearer's forefoot, specifically for hockey players who play at the defense position and are more subject to receiving hard shots on their forefoot.

Against this backdrop, there is a need in the industry for a tongue that may increase the freedom of ankle movement and provide further protection for the wearer's forefoot.

SUMMARY OF THE INVENTION

In accordance with a first broad aspect, the invention provides a skate boot for enclosing a human foot having a forefoot and a front ankle portion. The skate boot has a tongue comprising a first section covering the forefoot of the foot and a second section connected to the first section via a flexing zone. The flexing zone enables the second section to be movable in relation to the first section between a first position and a second position. In the first position the second section covers a portion of the front ankle portion of the foot, and in the second position, the second section overlaps a portion of the first section.

Other aspects and features of the present invention will become apparent to those of ordinary skill in the art upon review of the following description of specific embodiments of the invention in conjunction with the accompanying figures.

BRIEF DESCRIPTION OF THE DRAWINGS

A detailed description of the embodiments of the present invention is provided hereinbelow with reference to the following drawings, in which.

Figure 1:
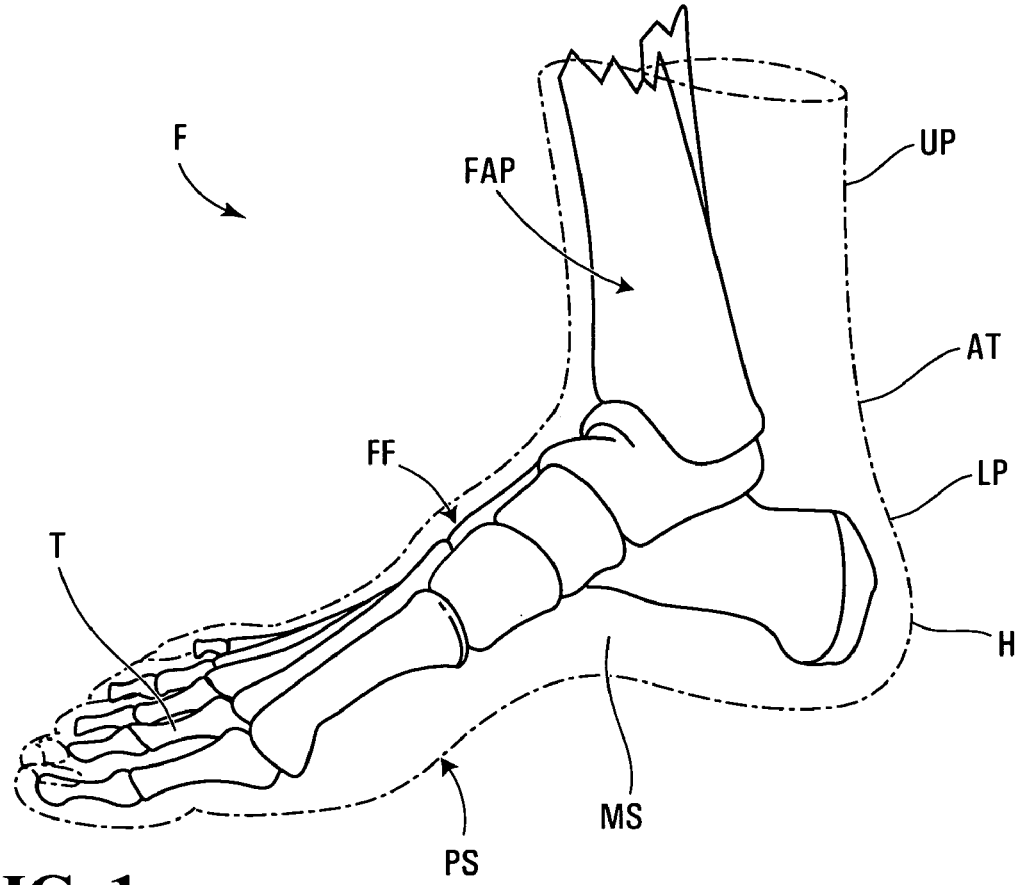
FIG. 1 shows a perspective view of a human foot with the integument of the foot shown in stippled lines and the bones of the foot shown in solid lines.

In the drawings, embodiments of the invention are illustrated by way of example. It is to be expressly understood that the description and drawings are only for the purposes of illustration and as an aid to understanding, and are not intended to be a definition of the limits of the invention.

DETAILED DESCRIPTION

Figure 2:
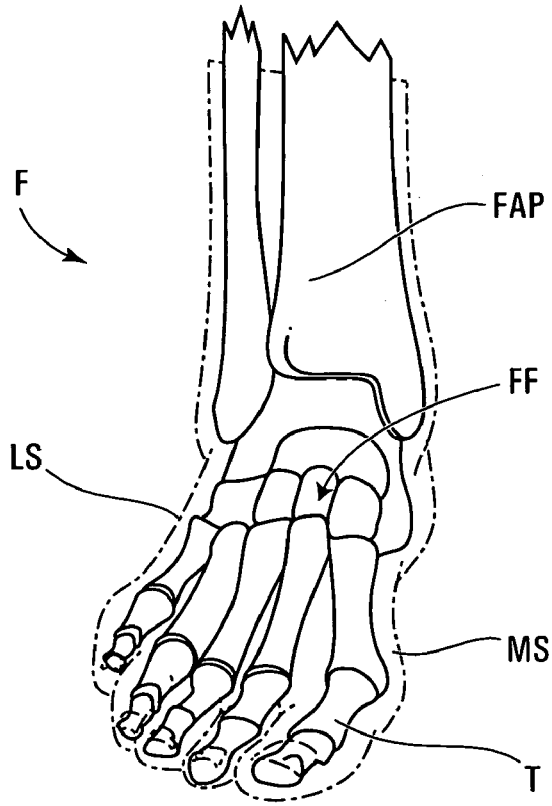
FIG. 2 shows a front elevational view of the foot of FIG. 1.

Shown in FIGS. 1 and 2 is a typical human foot F that includes toes T, a forefoot FF, a front ankle portion FAP, a plantar surface PS, a medial side MS and a lateral side LS. In addition, the human foot includes a heel H, and an Achilles tendon AT having an upper part UP and a lower part LP.

Figure 3:
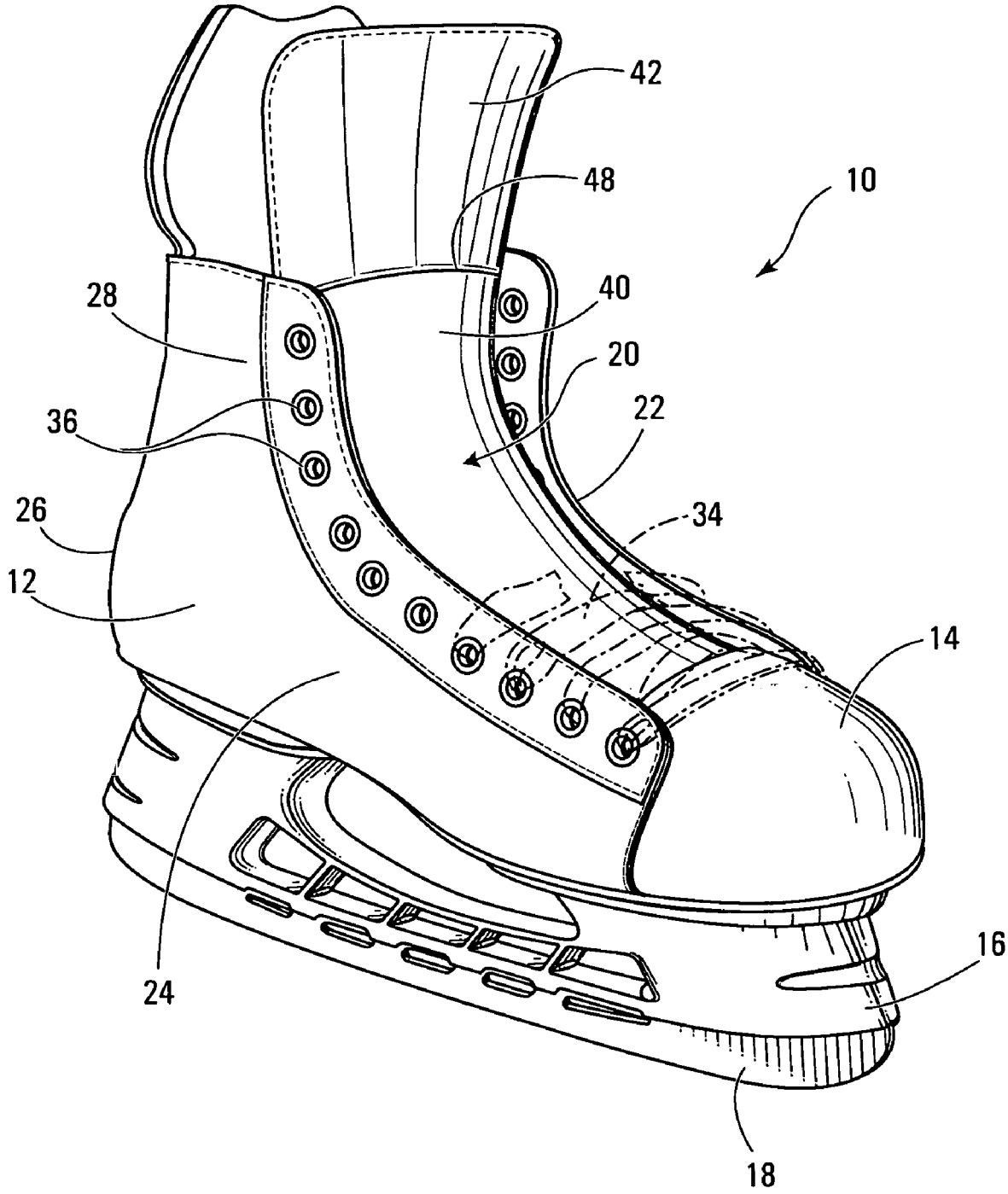
FIG. 3 shows a front perspective view of a skate boot having a tongue in accordance with an embodiment of the present invention.

Shown in FIG. 3 is a skate boot 10 that is suitable for enclosing a human foot, such as that described above with respect to FIGS. 1 and 2. The skate boot 10 includes an outer shell 12, a toe-cap 14, a blade holder 16, a blade 18 and a tongue 20.

The outer shell 12 is adapted for enclosing the heel H, the upper and lower parts UP, LP of the Achilles tendon AT, and the medial and lateral surfaces MS, LS of the foot F. As such, the outer shell 12 comprises a heel counter 26 for enclosing the heel H, an ankle portion 28 receiving the ankle and medial and lateral quarters 22, 24 facing the respective medial and lateral sides MS, LS of the foot F. The medial and lateral quarters 12, 14 extend forwardly from the heel counter 26.

It should be understood that the outer shell 12 of the skate boot is not a limiting feature of the present invention, and that the outer shell 12 can be formed of a single integral piece, or can be made of multiple pieces that are connected together to form the overall shape of the outer shell 12. In addition, the outer shell 12 can be formed of foam, plastic, leather, or any other suitable material or combination of materials known in the art, without departing from the spirit of the invention.

Similarly, the toe-cap 14, blade holder 16 and blade 18 are not limiting features of the present invention. In addition, any suitable form of blade holder 16 and blade 18 can be used with the skate boot 10 without departing from the spirit of the invention. Blade holders 16 and blades 18 are known in the art, and as such will not be described in further detail herein.

The tongue 20 of the skate boot 10 can be seen in more detail in FIGS. 4 to 7. The tongue 20 comprises a first end portion 30, a second end portion 32 and side portions 44, 46. In addition, the tongue 20 comprises an inner facing surface 39 and an outer facing surface 38. The inner facing surface 39 faces the forefoot FF and the front ankle portion FAP.

As shown in FIG. 3, the tongue 20 is adapted to fit between the sides 22 and 24 of the outer shell 12, such that the tongue 20 covers the forefoot FF and the front ankle portion FAP. In the embodiment shown, the skate boot 10 includes a lace 34 (shown in dotted lines) that extends through lace eyelets 36 in the sides 22, 24 of the outer shell 12 in a criss-crossing pattern. As such, when the lace 34 is tightened, the lace 34 acts to keep the tongue 20 in place.

Figure 4:
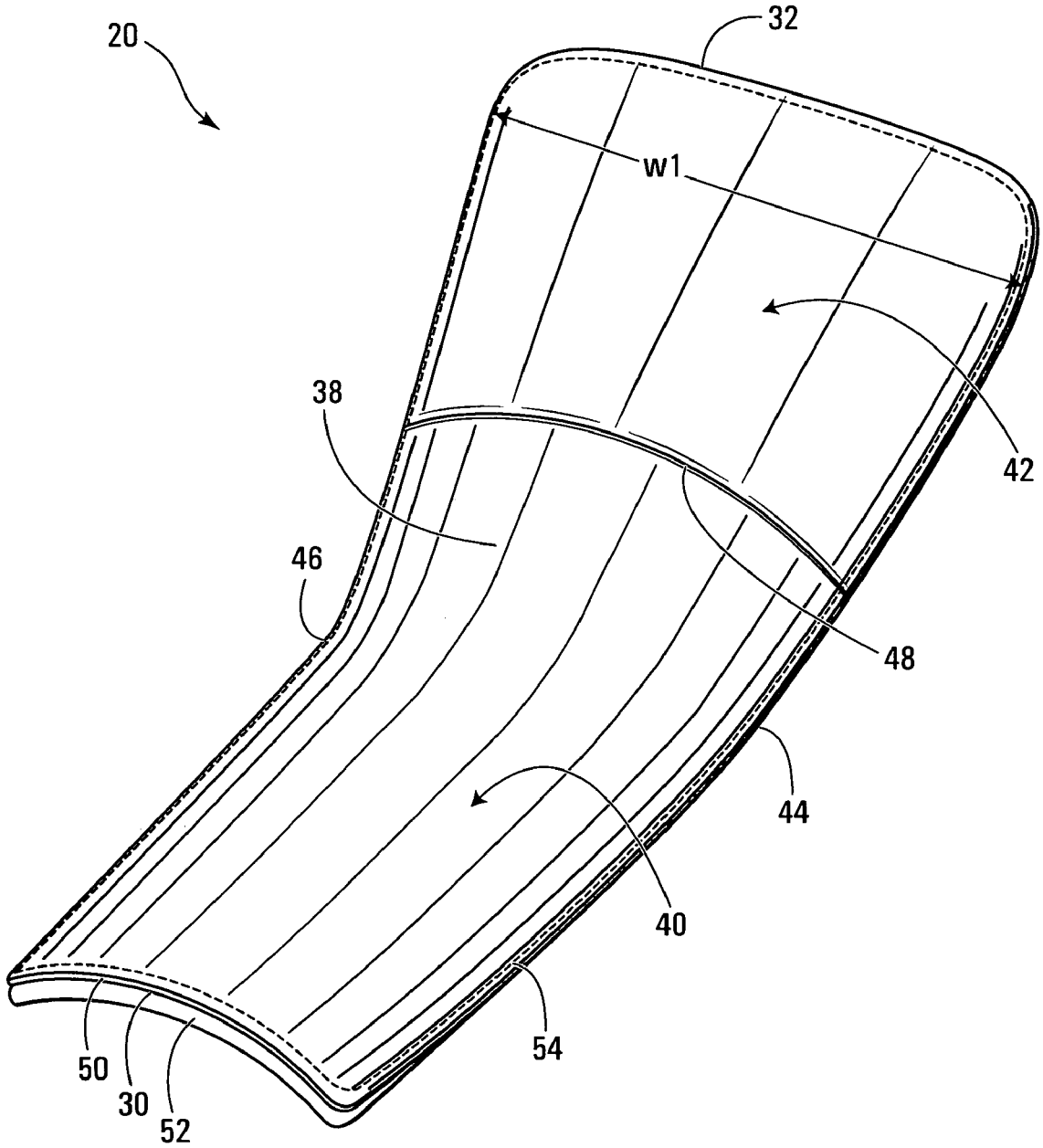
FIG. 4 shows a front perspective view of the tongue in a first position.

As shown in FIG. 4, the tongue 20 may be arched between the side portions 44, 46 for enabling the tongue 20 to better conform to the forefoot FF and the front ankle portion FAP. In addition, the tongue 20 may be arched as it extends from the first end portion 30 to the second end portion 32 for following the profile of the forefoot FF and the front ankle portion FAP.

The first end portion 30 is adapted for being positioned in proximity to the toes T. As such, in the non-limiting example of implementation shown in FIG. 3, the first end portion 30 is connected to the toe-cap 14. This can be achieved via stitching, adhesive or any other type of mechanical fastener known in the art.

Figure 5:
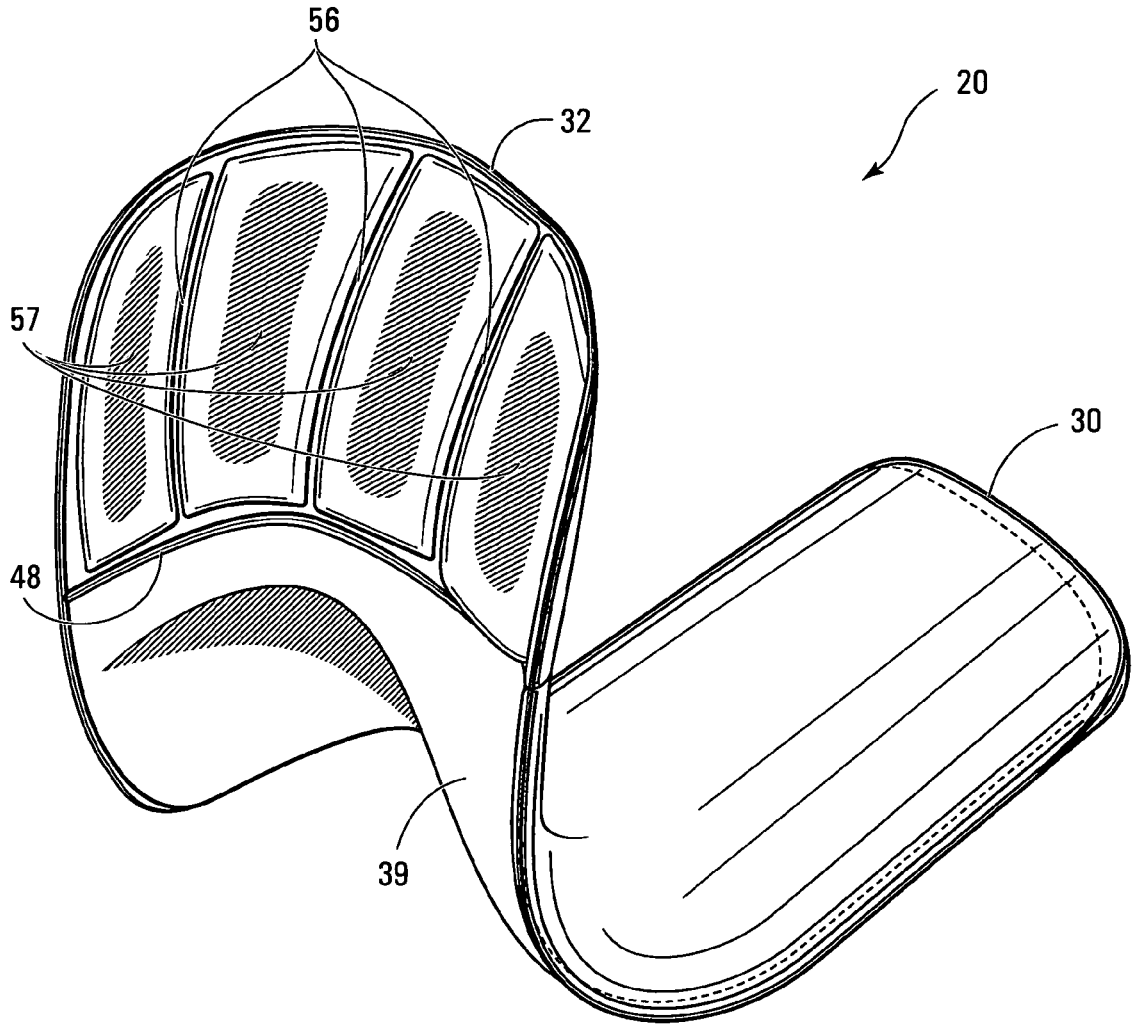
FIG. 5 shows a rear perspective view of the tongue of FIG. 4.

As better shown in FIGS. 4 and 5, the tongue 20 comprises a first section 40 and a second section 42, the second section 42 being connected to the first section 40 via a flexing zone 48. The flexing zone 48 enables the second section 42 to be movable between a first position and a second position in relation to the first section 40.

In the first position, as shown in FIGS. 3, 4 and 5, the first section 40 covers the forefoot FF and a portion of the front ankle portion FAP, while the second section 42 covers another portion of the front ankle portion FAP.

Figure 6:
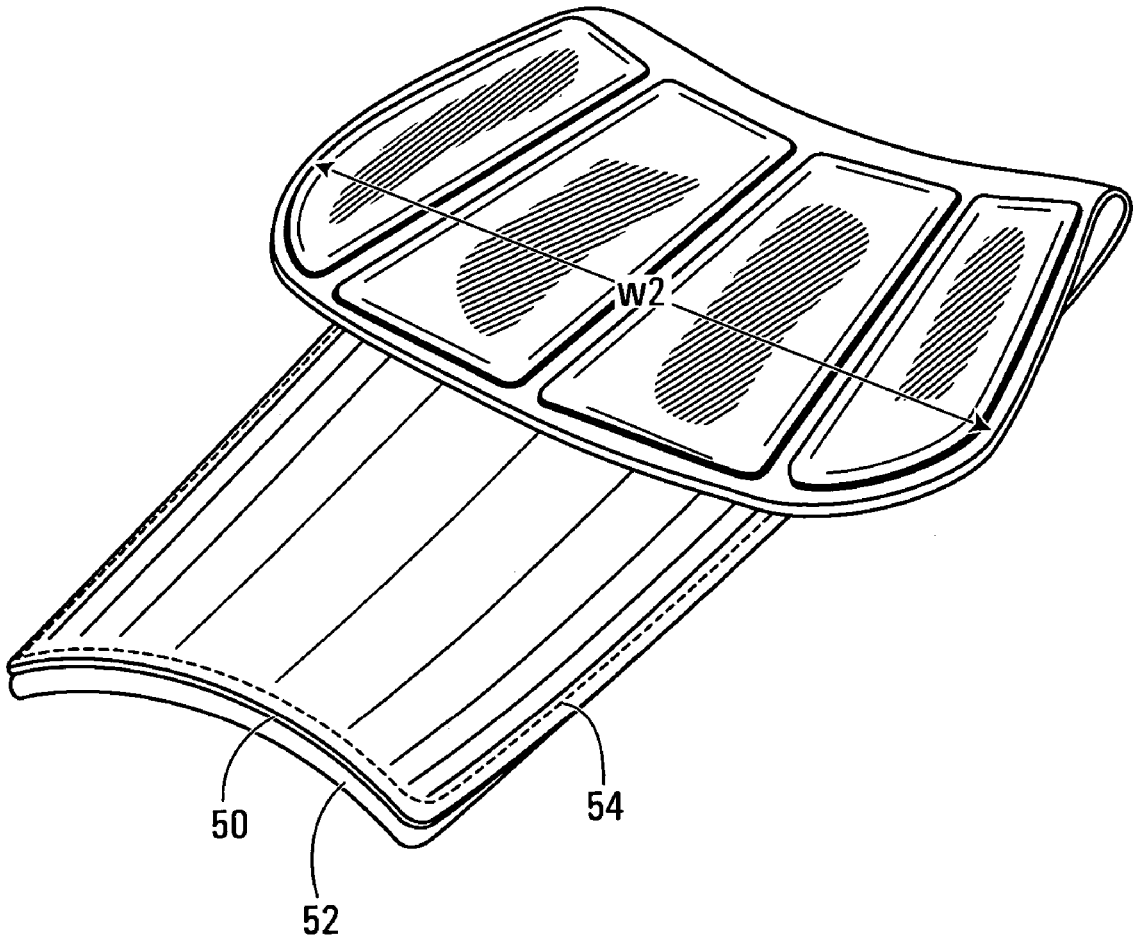
FIG. 6 shows a front perspective view of the tongue of FIGS. 4 and 5 in a second position.
Figure 7:
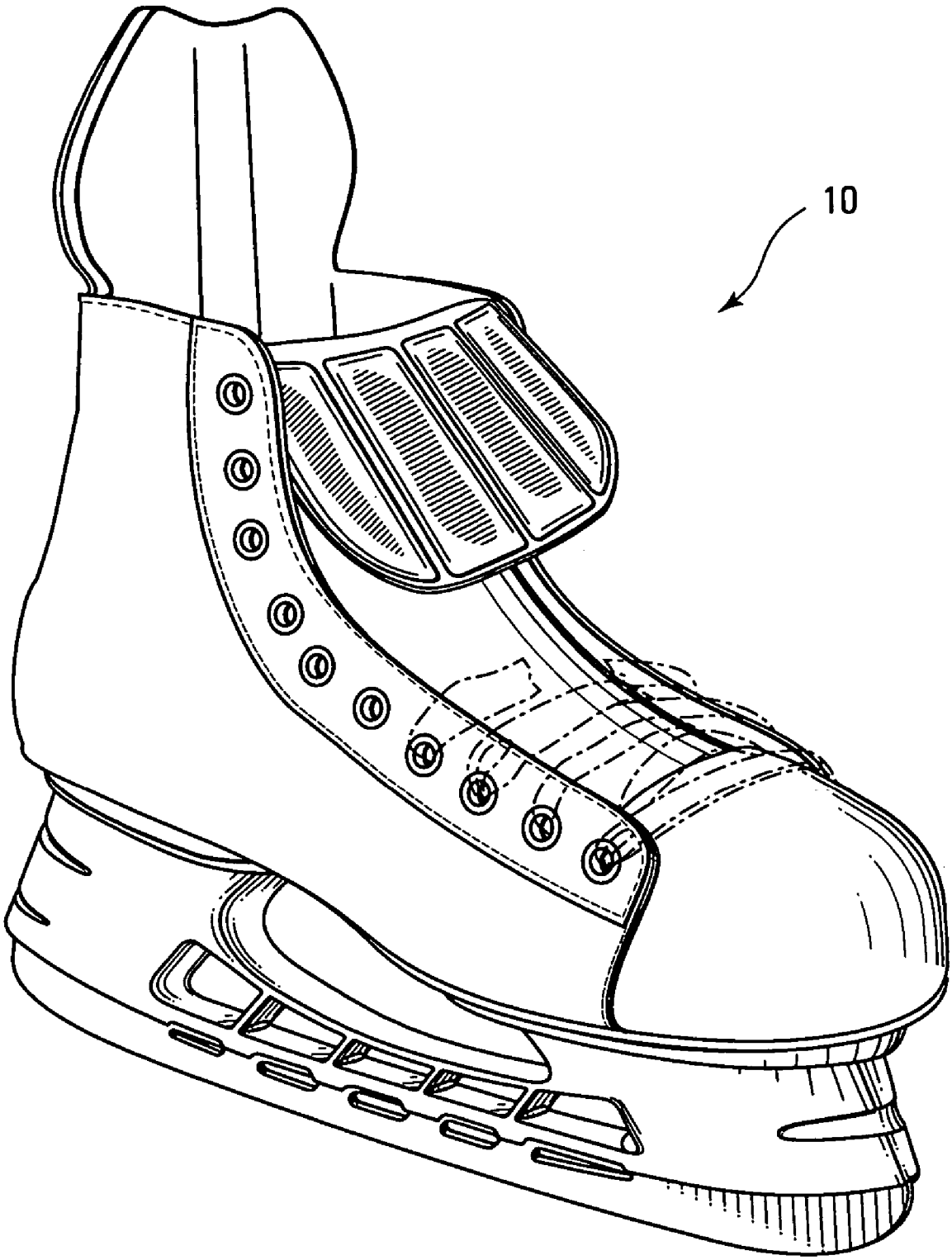
FIG. 7 shows a front perspective view of a skate boot with the tongue in the second position.

In the second position, as shown in FIGS. 6 and 7, the second section 42 overlaps a portion of the first section 40. When the second section 42 of the tongue 20 is in the second position, the second section 42 provides further protection and padding to the forefoot FF. In addition, in the second position, the second section 42 is no longer positioned in front of the front ankle portion FAP, thereby increasing the freedom of movement of the ankle. In fact, for a player who wears a leg pad that is long enough to cover the front ankle portion FAP, the player may then fold the second section 42 over the first section 40 since his/her leg pad offers enough protection for his/her front ankle portion FAP. In that way, the second section 42 overlaps a portion of the first section 40 for providing further protection for a portion of the forefoot FF.

It should be understood that the flexing zone 48 may be located higher or lower relative to the front ankle portion FAP according to the height of the sides 44, 46 of the skate boot. In fact, the lower the flexing zone 48 relative to the front ankle portion FAP, the longer the second section overlaps the first section of the tongue when the second section is in the second position.

In a non-limiting embodiment, the flexing zone 48 may be located high enough relative to the front ankle portion FAP, such that it is located slightly above the upper eyelets 36. In such a position, the second section 42 can be folded over the first section 40 when the wearer has laced the skate boot up to the upper eyelets. In such an embodiment, the height of the flexing zone 48 will be in accordance with the height of the sides of the boot 10 and the height of the upper eyelet 36.

In general, not all hockey players lace up their skate boots in the same manner. For example, some hockey players chose to lace up their skates such that the shoe lace extends through every eyelet in the skate boot. Other hockey players do not lace their skates all the way up, such that the upper one or two pairs of eyelets are not used. In order to facilitate these different manners of fastening skate boots, it is within the scope of the present invention for the tongue 20 to comprise two flexing zones 38. More specifically, the tongue 20 may include a first flexing zone 48, located slightly above the sides 44, 46 of the skate boot (as shown in FIG. 3), and a second flexing zone (not shown) located therebelow. In this manner, the second section 42 of the tongue 20 can be folded over the first section 40 of the tongue, regardless of how the wearer laces up his or her skate boots.

In the non-limiting embodiment shown in FIGS. 4 to 6, the first section 40, the second section 42 and the flexing zone 48 of the tongue 20 are integrally formed such that there is no separation of material between the three components. As such, the flexing zone 48 is formed of the same material as the first section 40 and the second section 42. In such an embodiment, the flexing zone 48 may be formed by thermally compressing the material in the region that will form the flexing zone 48, such that the material in the flexing zone 48 is compressed to a thinner thickness than the material in either the first section 40 or the second section 42. In addition, to forming a thinner region of material, the compression causes a V-shaped groove to be formed between the first section 40 and the second section 42. In the non-limiting embodiment shown in FIGS. 4 to 6, the V-shaped groove is formed in the inner facing surface 39. It should, however, be understood that the V-shaped groove could be formed in the outer facing surface 38, or two smaller V-shaped grooves could be formed in both the inner facing surface 39 and the outer facing surface 38, such that the region of thinner material is positioned between the two smaller V-shaped grooves. The combination of the thinner region of material, and the V-shaped groove, causes the flexing zone 48 to form a hinge about which the second section 42 is able to move in relation to the first section 40.

Although, in the embodiment described above, the flexing zone 48 is formed of a thinner region of material and a V-shaped groove, it should be understood that any other configuration that enables the second section 42 to move between the first position and the second position as described above, is included within the scope of the present invention. For example, the first section 40, second section 42 and the flexing zone 48 could be formed of separate materials and can be connected together via stitching, adhesive, or any other suitable fastening methods known in the art. In such an embodiment, it is possible for the flexing zone to be formed of an elasticized material, a pliable material, or a mechanical hinge that enables the second section 42 to move between the first position and the second position.

As shown in FIGS. 5 and 6, the second section 42 has flexing regions 56 that enable the second section 42 to expand laterally as it moves from the first position to the second position. As such, the second section 42 is of a first width "w1" when it is in the first position, as shown in FIG. 4, and is of a second width "w2" that is greater than "w1" when it is in the second position, as shown in FIG. 6.

In the non-limiting example of implementation shown in FIGS. 4 to 6, the flexing regions 56 are formed of the same material as the second section 42. In such an embodiment, the flexing regions 56 may be formed by thermally compressing the material in the regions that will form the flexing regions 56, such that the material in the flexing regions 56 is compressed to a thinner thickness than the material forming the remainder of the second section 42. In addition to forming thinner regions of material, the thermal compression causes V-shaped grooves to be formed between thicker regions of the second section 42. As such, the second section includes ridges 57 of thicker material, separated by flexing regions 56 that include a thinner region of material and a V-shaped groove. In the non-limiting embodiment shown in FIGS. 5 and 6, the V-shaped grooves of the flexing regions 56 are formed in the inner facing surface 39.

As shown in FIGS. 5 and 6, the flexing regions 56 are formed substantially perpendicular to the flexing zone 48. In the non-limiting embodiment shown in FIGS. 4 to 6, the second section 42 includes three flexing regions 56. More or less flexing regions 56 can be included without departing from the spirit of the invention. The combination of the thinner regions of material and the V-shaped grooves of the flexing regions 56, enable the flexing regions 56 to expand open as the second section 42 moves from the first position to the second position.

In an alternative non-limiting embodiment, the flexing regions 56 could be formed of a separate material than the second section 42 and could be connected to the second section 42 via stitching, adhesive, or any other suitable fastening methods known in the art. In such an embodiment, it is possible for the flexing zone to be formed of an elasticized material, a pliable material, or any other material or device that enables the second section 42 to expand as it moves from the first position and the second position.

In a non-limiting example of implementation, the tongue 20 has at least one foam layer. As such, the tongue 20 can be formed of a single integral piece of foam or alternatively can be formed of multiple layers of foam. The foam layer can be formed of ethylene vinyl acetate (EVA) foam, polyethylene foam, ethylene polypropylene foam and/or polyurethane foam. It should be understood that the tongue 20 can also include additional materials such as leather.

In the non-limiting embodiment shown in FIGS. 4 to 6, the tongue 20 is formed of a first layer of foam 50 and a second layer of foam 52 that are attached together via stitching 54. It should, however, be understood that other methods of attaching the two layers 50, 52 together such as adhesive, thermal bonding or staples could also be used without departing from the spirit of the invention.

It should be understood that in the case where the tongue 20 is formed of multiple foam layers, each layer can have a different density contained within the previously described range. For example, in the embodiment shown in FIGS. 4 to 6, wherein the tongue has a first layer of foam 50 and a second layer of foam 52, the two foam layers can be of different densities. More specifically, since the first layer of foam 50 includes a surface that defines the outer facing surface 38 of the tongue 20, the first layer 50 might have a relatively high density that enables the outer facing surface 38 to provide better protection to the wearer's forefoot in the case where the wearer's forefoot is hit with a foreign object, such as a hockey stick. Whereas, since the second layer of foam 52 includes a surface that defines the inner facing surface 39 of the tongue 20, the second layer of foam 52 might have a relatively low density, such that the inner facing surface 39 is soft and can easily conform to the wearer's foot, so as to provide a comfortable fit for the wearer.

The above description of embodiments should not be interpreted in a limiting manner since other variations, modifications and refinements are possible within the spirit and scope of the present invention. The scope of the invention is defined in the appended claims and their equivalents.

The invention claimed is:

1. A skate boot for enclosing a foot of a player, the foot having a forefoot and a front ankle portion, said skate boot having a tongue and an ankle portion with upper eyelets, said tongue comprising:

a) a first section covering the forefoot of the foot;

b) a second section connected to said first section via a flexing zone, said flexing zone having a thickness less than the first and second sections to permit folding and being located slightly above said upper eyelets and enabling said second section to be movable between a first position, in which said second section covers a portion of the front ankle portion of the foot; and a second position, in which said second section overlaps a portion of said first section, wherein, in use, the player can fold said second section over said first section for wearing said boot with said tongue in said second position whereby further protection for a portion of the forefoot is provided, wherein said second section comprises at least one flexing region for enabling said second section to expand laterally as it moves from said first position to said second position.

2. A skate boot as defined in claim 1, wherein said flexing zone comprises a V-shaped groove.

3. A skate boot as defined in claim 1, said tongue comprises a first layer attached to a second layer, said first and second layers being made of foam.

4. A skate boot as defined in claim 3, wherein said first layer comprises on inner surface facing the foot, said first layer having a first density, said second layer having a second density, said second density being greater than said first density.

5. A skate boot as defined in claim 1, wherein said flexing zone is a first flexing zone, said tongue further comprising a second flexing zone located below said first flexing zone.

6. A skate boot as defined in claim 1, wherein said first section, said second section and said flexing zone are integrally formed.

7. A skate boot as defined in claim 6, wherein said first section is of a first thickness, said second section is of a second thickness and said flexing zone is of a third thickness, wherein said third thickness is less than said first thickness and said second thickness.

8. A skate boot as defined in claim 7, wherein said flexing zone comprises a V-shaped groove.

9. A skate boot as defined in claim 8, wherein said flexing region is of a fourth thickness, wherein said fourth thickness is less than said first thickness and said second thickness.

10. A skate boot as defined in claim 9, wherein said flexing region comprises a groove extending substantially perpendicular to said flexing zone.

11. A skate boot as defined in claim 8, wherein said tongue is formed of multiple layers of material.

12. A skate boot as defined in claim 11, wherein said tongue comprises a first layer attached to a second layer.

13. A skate boot as defined in claim 12, wherein one of said first and second layers is made of foam.

14. A skate boot as defined in claim 12, wherein both said first and said second layers are made of foam.

15. A skate boot as defined in claim 14, wherein said first layer comprises an inner surface facing the foot, said first layer having a first density, said second layer having a second density, said second density being greater than said first density.

16. A skate boot as defined in claim 14, wherein said foam is selected from the group consisting of ethylene vinyl acetate (EVA) foam, polyethylene foam, ethylene polypropylene foam and polyurethane foam.

17. A skate boot as defined in claim 11, wherein said first section, said second section and said flexing zone are integrally formed.

18. A skate boot as defined in claim 17, wherein said first section is of a first Thickness, said second section is of a second Thickness and said flexing zone is of a third thickness, wherein said third thickness is less than said first thickness and said second thickness.

19. A skate boot as defined in claim 18, wherein said flexing zone comprises a V-shaped groove.

20. A skate boot as defined in claim 19, wherein said second section comprises at least one flexing region for enabling said second section to expand laterally as it moves from said first position to said second position.

21. A skate boat as defined in claim 20, wherein said flexing region is of a fourth thickness, wherein said fourth thickness is less than said first thickness and said second thickness.

22. A skate boot as defined in claim 21, wherein said flexing region comprises a groove extending substantially perpendicular to said flexing zone.

23. A skate boot for enclosing a foot of a player, the foot having a forefoot and a front ankle portion, said skate boot having a tongue and an ankle portion with upper eyelets, said tongue comprising:

a) a first section covering the forefoot of the foot;

b) a second section connected to said first section via a flexing zone, said flexing zone having a thickness less than the first and second sections to permit folding and being located slightly above said upper eyelets and enabling said second section to be movable between a first position, in which said section covers a portion of the front ankle portion of the foot; and a second position, in which said second section overlaps a portion of said first section, wherein, in use, the player can fold said second section over said first section for wearing said boot with said tongue in said second position whereby further protection for a portion of the forefoot is provided, said tongue comprises a first layer attached to a second layer, said first and second layers being made out of foam, wherein said first layer comprises an inner surface facing the foot, said first layer having a first density, said second layer having a second density, said second density being greater than said first density.

* * * * *